United States Patent [19]

Wasterval, Jr. et al.

[11] Patent Number: 4,885,893

[45] Date of Patent: Dec. 12, 1989

[54] WELL MAST STRUCTURE

[75] Inventors: Philip W. Wasterval, Jr.; James E. Armstrong, both of Houston, Tex.

[73] Assignee: IMI Engineering, Co., Houston, Tex.

[21] Appl. No.: 94,867

[22] Filed: Sep. 10, 1987

[51] Int. Cl.[4] ..... E04H 12/34; B66C 23/34

[52] U.S. Cl. ..... 52/745; 52/123.1; 52/741

[58] Field of Search ..... 52/637, 638, 648, 40, 52/741, 745, 111, 123.1; 182/178

[56] References Cited

U.S. PATENT DOCUMENTS

| | | | |
|---|---|---|---|
| 848,304 | 3/1907 | Hines | 52/637 X |
| 2,268,796 | 1/1942 | Brauer | 52/111 X |
| 2,577,642 | 12/1951 | Woolslayer et al. | 52/111 X |
| 2,583,072 | 1/1952 | Wilson | 52/741 X |
| 3,185,265 | 5/1965 | White | 52/111 X |
| 4,134,237 | 1/1979 | Armstrong | 52/745 X |

FOREIGN PATENT DOCUMENTS

| | | | |
|---|---|---|---|
| 440360 | 2/1927 | Fed. Rep. of Germany | 52/111 |
| 572557 | 9/1977 | U.S.S.R. | 52/111 |

*Primary Examiner*—Michael Safavi

*Attorney, Agent, or Firm*—Pravel, Gambrell, Hewitt, Kimball & Krieger

[57] ABSTRACT

A well mast apparatus is disclosed in the form of multiple, separately connectable sections including a lower mast section, an upper mast section and, if desired, several subsequent intermediate mast sections. The mast sections are provided with lifting rings positioned thereon for balancing the mast sections upon lifting. The upper mast section includes a connector offset from its lifting ring for controlling and guiding pivotal movement of the upper mast section relative to the lower mast section as the well mast is being raised. The lifting ring offset from the pivotable connector, which is interengaged between the fixed vertical lower section and the balanced horizontal second mast section, guides the direction and speed of rotation of the second mast section relative to the lower mast section during installation.

11 Claims, 5 Drawing Sheets

WELL MAST STRUCTURE

BACKGROUND OF THE INVENTION

1. Technical Field of the Invention

This invention relates to masts and methods for raising or erecting masts, particularly on offshore drilling platforms or at relatively inaccessible sites on land.

2. Description of the Prior Art

Several types of well masts have been used in connection with oil wells. Often, these masts have been portable for movement between well sites, particularly for offshore or remote area drilling. It has been customary to have masts of telescoping sections which can be extended one above the other to make a mast of desired height.

One type of mast took the form of two section telescoping masts with an upper section telescoped into a lower section. The entire assembly was transported as a unit from one location to the next. The telescoped mast sections as a unit made the unit heavy. Further, on arrival at the drilling site, the entire collapsed assembly was tilted up as a unit into vertical position, at which time the upper section was then extended. Tilting of the entire mast as a unit was undesirable both for load reasons and in that it caused damage and increased wear and tear on the mast structure.

A second type of portable mast used a three-section telescoping mast with an intermediate section and an upper section telescoped within a lower section. Other than the added section, the three-section mast operated in the manner of the two-section masts. Because of the added section, weight, load and hauling problems only increased.

U.S. Pat. No. 4,134,237, of which applicant Armstrong is an inventor, issued Jan. 16, 1979 and disclosed a third type of portable mast. This mast comprised a modular section mast having a lower or base section first mounted in a vertical position on a substructure. Upper and, if required, intermediate sections, were positioned one at a time as additional sections within the open side of the fixed vertical lower section. The additional sections were then extended upwardly, one at a time, from the lower section to form a fully extended mast of desired height. This type of mast, although affording advantages over telescoping masts, had several undesirable features. At the drilling site, the sections were stored in a horizontal position. Erection of the mast required lifting of each of the modular sections from the horizontal position to a vertical upright position prior to installing them in the lower section.

This latter type of mast structure suffered problems when raising the mast sections from the horizontal storage position to the upright position. In raising the mast sections, they were connected at the end to be the upper end with a lifting cable while in the storage position. As the lifting cable raised this end of the mast section, the other or free end of the lifted mast section dragged across the drilling platform or other well site surface, damaging both the well site surface and mast structure.

SUMMARY OF THE INVENTION

Briefly, according to the present invention, an improved well mast apparatus for use with a well platform is provided. The well mast apparatus comprises a lower mast section, and additional mast sections including at least an upper or second mast section and, if desired, one or more intermediate or third mast sections. The mast sections are provided with lifting rings or hooks positioned between their ends for balancing the mast sections in a horizontal position upon lifting and movement. Additionally, the additional mast sections are provided with a pivotable connector offset from the lifting ring for controlling and guiding pivotal movement of the upper mast section relative to the lower mast section.

The offset of the lifting ring from the pivotable connector and the lifting rings on the balanced horizontal second mast section operably guides the direction and speed of rotation of each of the additional sections relative to lower section as the mast apparatus of the present invention is being raised.

The well mast apparatus of the present invention provides a method to quickly and efficiently erect a mast structure while reducing damage to the mast sections during raising or erection.

BRIEF DESCRIPTION OF THE DRAWINGS

The objects, advantages and features of the invention will become more apparent by reference to the drawings which are appended hereto wherein like numerals indicate like parts and wherein an illustrative embodiment of the invention is shown, of which.

DESCRIPTION OF THE PREFERRED EMBODIMENT

Figure 10:
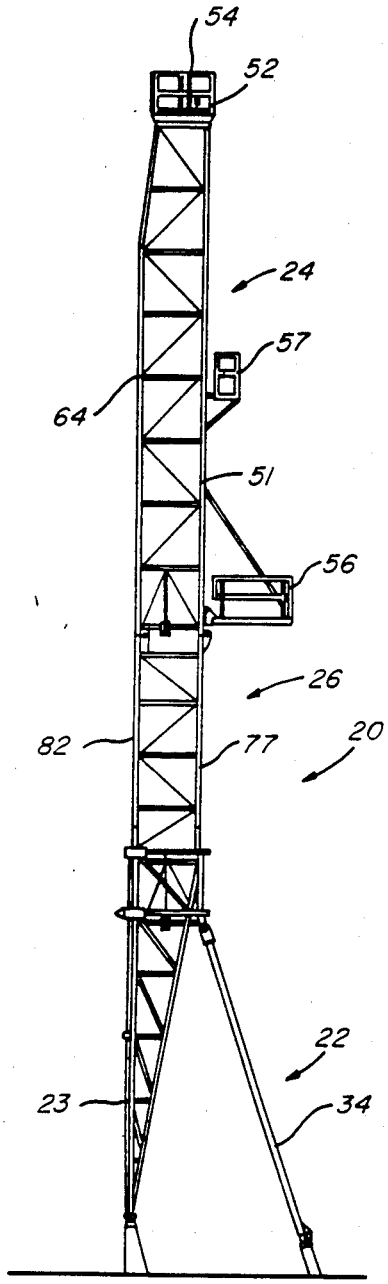
FIG. 10 is an elevation view of a well mast according to the present invention in its raised position.

The well mast structure of the present invention, indicated generally at 20 in FIG. 10, is adapted to be assembled or erected on a well drilling site. The well drilling site may be a foundation on the ground, a truck bed, an offshore platform, the upper section of another well mast structure or other suitable substructures. The preferred well mast structure 20 includes a lower or first mast section 22, and additional mast sections including at least an upper or second mast section 24, and, if required, one or more intermediate or third mast sections 26.

Figure 1:
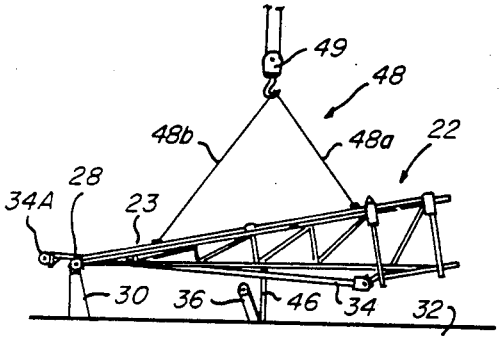
FIGS. 1, 2 and 3 are elevation views of a well mast apparatus according to the present invention during initial stages of its being raised or erected.
Figure 15:
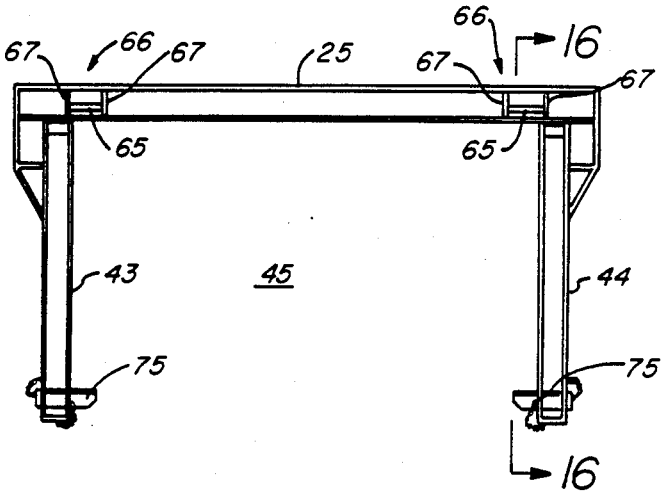
FIG. 15 is a view taken along the lines 15—15 of FIG. 2.
Figure 16:
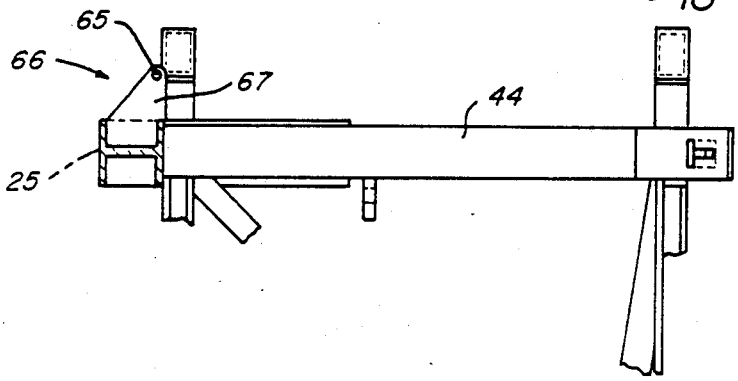
FIG. 16 is a view taken along the lines 16—16 of FIG. 15.

Though not shown, a conventional lifting crane is provided at the drilling site for lifting the mast sections as the mast 20 is being assembled. The lower mast section 22 is shown (FIG. 1) in a substantially horizontal position during an initial stage of assembling the mast structure 20. A lower end of mast section 20 is provided with a pivotable attaching means or mast shoes 28 on each of a pair of support legs 23 (FIGS. 1 and 2) for attachment to respective upright pedestals or stands 30 on a sub-base 32 at the well platform or drilling site. The support legs 23 of lower mast section 22 are connected at various positions along their longitudinal extent by lateral or cross-beams 25 (FIGS. 15 and 16). The pedestals 30 are adapted to fit within and be pivotally connected to mast shoes 28 by suitable connector bolts, pins or the like.

Figure 2:
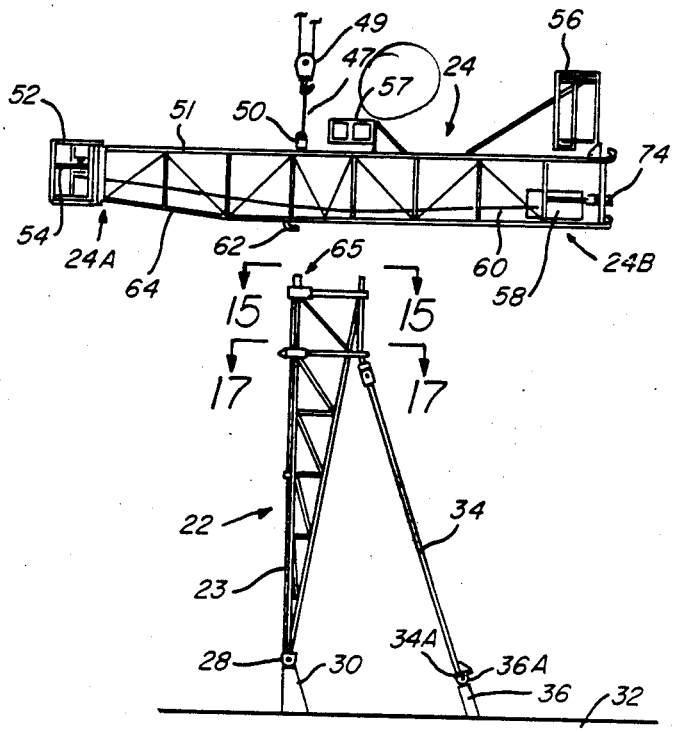
Figure 17:
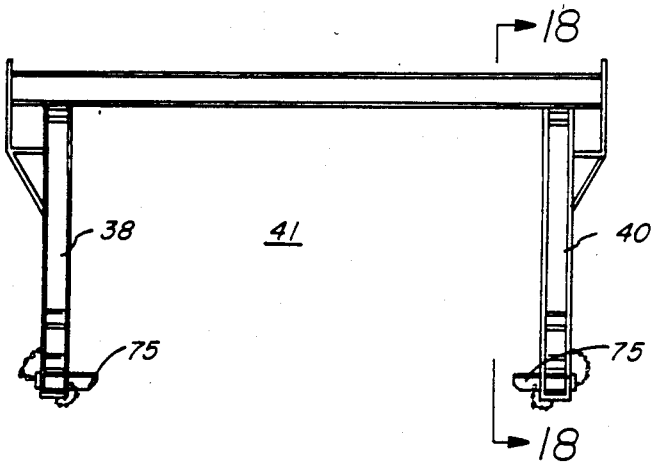
FIG. 17 is a view taken along the lines 17—17 of FIG. 2.
Figure 18:
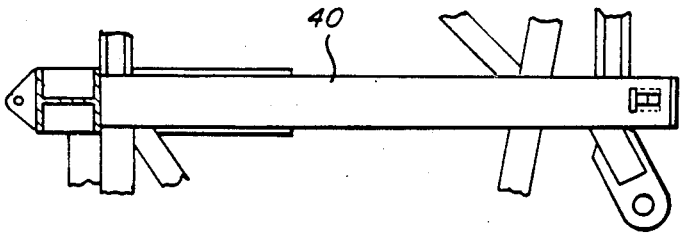
FIG. 18 is a view taken along the lines 18—18 of FIG. 17.

The lower mast section 22 also includes a pair of spaced, pivotal support legs 34 pivotally connected at their upper ends to frame members 43 and 44 (FIG. 15) of like construction to frame members 38 and 40 (FIGS. 17 and 18) mounted between support legs 23 and support members 36. The frame members 38 and 40, along with frame members 43, together with the upper cross-beams form a generally U-shaped box 45 at the upper end of the lower mast section 22. Further, no cross-beams are provided between either the spaced support legs 34 or the spaced support members 36. In this manner, an elongate, U-shaped receiving channel or slot 41 (FIG. 17) is formed in the lower mast section 22 once it is installed and raised (FIG. 2).

A mast shoe 34A (FIG. 1) is formed at the lower end of the mast section 20 on each of the pivotal support legs 34 for attachment to respective upright pedestals or stands 36 on the well drilling site 32. The pedestals 36 are adapted to fit within and be connected to the mast shoes 34A by suitable connector pins, bolts 36A or the like.

Prior to transport to the drilling site, the pivotal support legs 34 are each secured to their respective support legs 23 by ropes or other suitable means. The lower mast section 22 is then connected to a four part sling 48 including a pair of upper sling members 48*a* and a pair of lower sling members 48*b* beneath a crane hook 49. The lower mast section 22 is then lifted and moved to a position where the mast shoes 28 can be connected to the stands 30 by suitable pins or the like.

Once the mast shoes 28 are connected to the stands 30, the support legs 34 are released. They remain in position, however, because of temporary support legs or props 46, until lifting of the lower mast section 22 begins. The lower pair of sling members 48*b* are then disconnected from the support legs 23 and the crane hook 49 raised. As the crane hook 49 is raised, the lower mast section 22 is then tilted gradually upwardly by lifting forces imposed from the crane hook 49. Tilting continues with support legs 34 pivoted outwardly due to their weight until the support legs 23 are in the upright position shown in FIG. 2. At this point, the pivotal support legs 34 will be hanging generally vertically. They are then moved and pivoted forward to the position shown in FIG. 2 so that their mast shoes 34A may be connected to the stands 36, completing installation of the lower mast section 22.

The crane hook 49 is then connected by a lifting sling 47 to a lifting bar 50 on each of a pair of support legs 51 of the upper mast section 24. The bar 50 is preferably positioned at the horizontal centroid of mast section 24 so that during its lifting and movement, the mast section 24 will maintain a substantially horizontal position, as shown in FIG. 2. Mast section 24 maintains this balanced horizontal position when lifted from its horizontal storage position for connection to the mast section 22.

The upper mast section 24 is provided with a conventional crown platform 52 and crown block 54, its upper end 24A and a racking board 56 at its lower end 24B. A travelling block 58 is connected to the crown block 54 by a suitable strength of temporary rope line 60. The travelling block 58 is fixedly attached to the upper mast section during initial installation phases (FIG. 2). The upper mast section is also illustrated with a racking board support 56. The mast structure 22 is provided with the other usual conventional mast structure, such as ladders and the like, although not shown in the drawings to preserve clarity.

Figure 3:
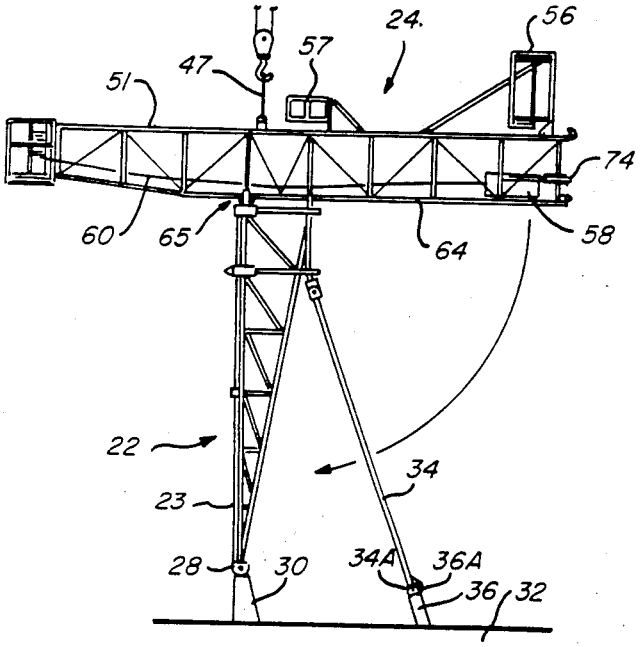

As best shown in FIGS. 2 and 3, a hook connector 62 is mounted on each of a pair of spaced, parallel support legs 64 laterally offset from the lifting ring 50 for controlling and guiding pivotal movement of the upper mast section 24 relative to the lower mast section 22, as will be set forth below.

The connector hooks 62 on mast section 24 are adapted to engage with pivot rods 65 (FIGS. 3, 15 and 16) and pivot within a corresponding set of pivot sockets (FIGS. 2 and 3) mounted with support plates 66 and 67 above support legs 23 of mast section 22 (FIGS. 15 and 16).

Figure 4:
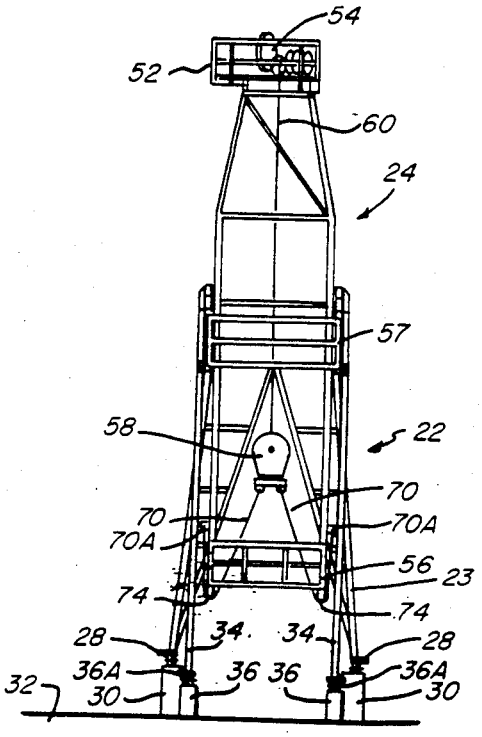
FIG. 4 is an elevation view taken at 90° from FIGS. 1, 2 and 3 during further stage of raising the well mast according to the present invention.

During raising of the mast 20, the upper section 24 is brought into a position (FIG. 3) where the connector hooks 62 are inserted into the pivot sockets 65 of lower mast section 22. After this connection is made, the force exerted by crane hook 49 is gradually removed and the mast section 24 is permitted to pivot slowly downwardly (FIG. 3) to a position within the lower mast section 22 (FIG. 4). Horizontally slideable latch pins 75 (FIGS. 15 and 17) are then moved inwardly to the position shown to insure that upper section 24 remains in telescoping position within lower mast section 22.

Figure 5:
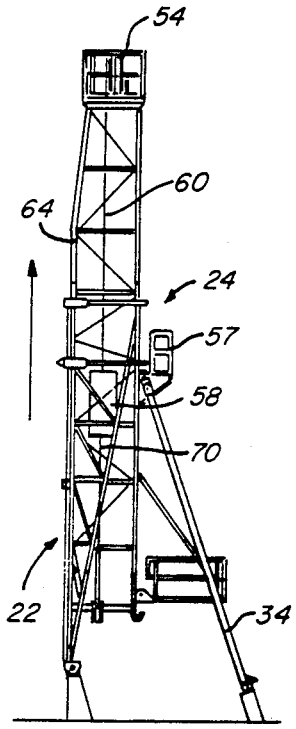
FIGS. 5, 6, 7, 8 and 9 are elevation views of a well mast according to the present invention during further stages of its being raised.
Figure 6:
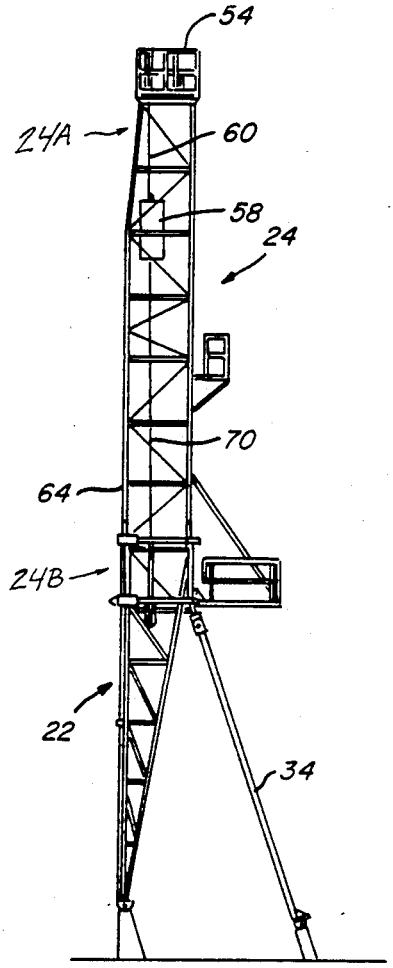

The rope line 60 is then connected to a conventional drilling line mounted on conventional draw works of the drilling platform. The rope line 60 is then used to pull the drill line from the draw works through the crown block 54 and travelling block 58 to complete their stringing up or reeving. Once this has been done, the crown block 54 is then connected through the drilling line to the draw works and the travelling block 58 is released to hang within the mast sections 22 and 24 (FIG. 4). Raising lines 70 which are fixedly attached at an upper end 70A and side portions of the upper end of mast section 22 are then passed over pulley wheels 74 (FIGS. 2, 3, 4 and 11) mounted at the lower end 24B of upper mast section 24 and attached to the travelling block 58 (FIG. 4). The draw works then reels up the drilling line to raise the travelling block 58. As the travelling block 58 moves upwardly (FIG. 5), the raising lines 70 pull the upper mast section 24 upwardly within the lower section 22. The latch pins 75 insure that this movement is a telescoping one. Upward telescoping movement of upper section 24 within lower section 22 continues to a point (FIG. 6) where suitable locking mechanisms, such as locking pins or wedges at the upper end 22A of mast section 22 may be used to connect with the lower end 24B of mast section 24 to interconnect the mast sections and lock them together.

If the desired mast requires only the lower section 22 and upper section 24, the mast 20 according to the present invention has now been assembled (FIG. 6) and raised for drilling operations. In some situations, however, a taller mast is needed, requiring that an intermediate mast section 26 (FIG. 7) be installed.

Figure 7:
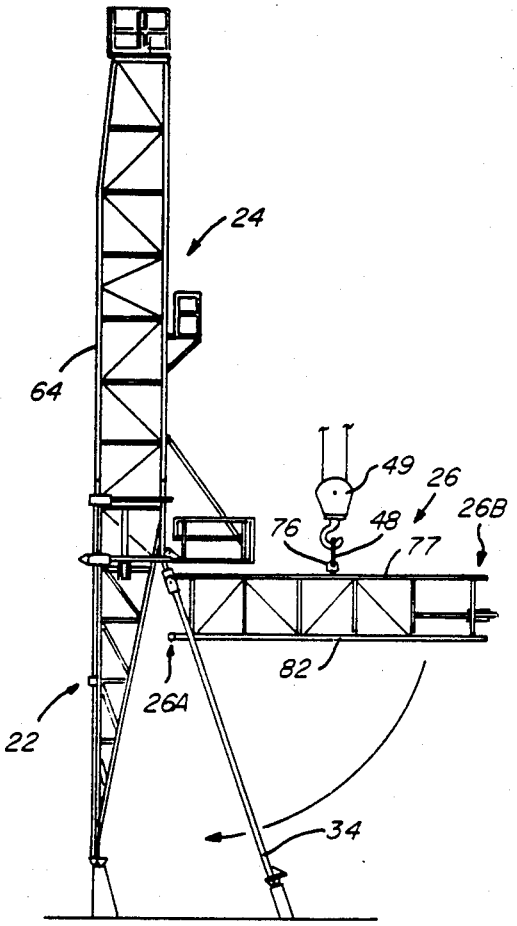
Figure 8:
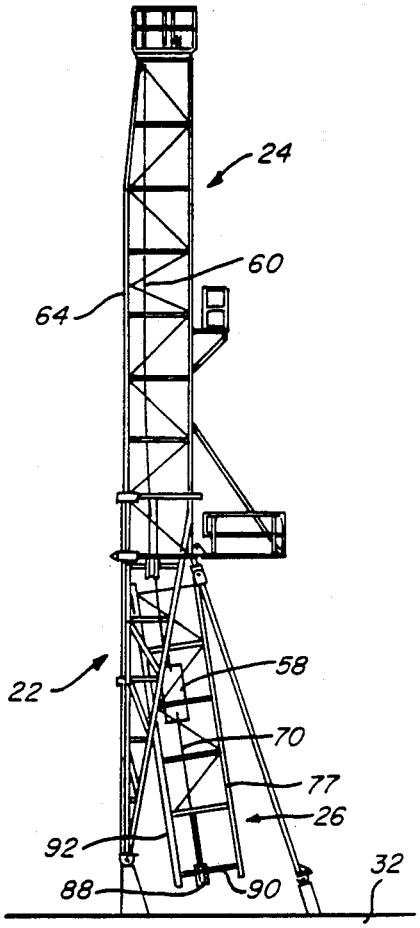
Figure 12:
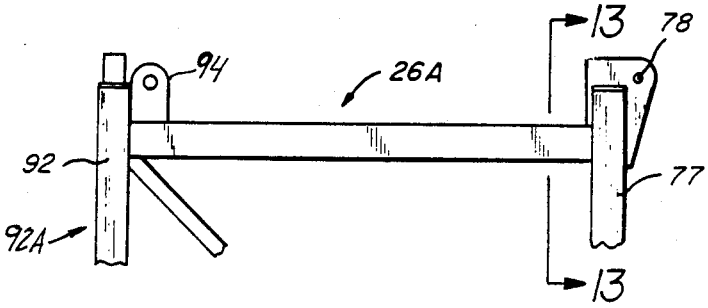
Figure 13:
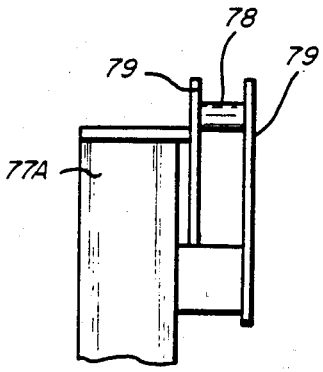
FIG. 13 is a view taken partly in cross-section along the lines 13—13 of FIG. 12.
Figure 14:
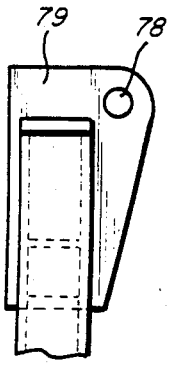
FIG. 14 is an enlarged view of a portion of the structure of FIG. 12.

The intermediate mast section 26 (FIG. 7) has an upper end 26A (FIGS. 12, 13 and 14) and a lower end 26B (FIG. 7) with a lifting ring 76, positioned therebetween. One lifting ring 76 is positioned on each of support legs 77 on mast section 26 in a like manner to the lifting sling 47 of upper mast section 24, at the horizontal center of mass or centroid of the intermediate mast section 26. The upper end 26A end of intermediate mast section 26 includes a pivot pin 78 (FIG. 13) mounted between side plates 79 adjacent an upper end 77A of each of support legs 77. The pivot pins 78 are adapted to engaged connector hooks 86 (FIG. 11) mounted beneath support legs 51 at the lower end 24B of the upper mast section 24. The intermediate mast section 26 is installed to be raised by engaging its lifting ring 76 with crane hook 49 while mast section 26 is in its horizontal storage position. The mast section 26 is then lifted and moved, but maintains its horizontal position during such lifting and movement, due to the location of the lifting ring 76. The mast section 26 is then moved to a position as shown in FIG. 7 where each of the pivot pins 78 engages and fits within one of the hooks 86 detailed in FIG. 11 . The force exerted by crane hook 49 is gradually reduced, permitting the intermediate mast section 26 to descend to its lower position (FIG. 8). The interengagement of hooks 86 and pivot pins 78 permits controlled and guided pivotable movement of the intermediate mast section 26 relative to the lower mast section 22.

A pair of guide pulleys 88 are mounted on lower supports 90 between support legs 77 and 92 at the lower end 26B of intermediate mast section 26. The pulleys 88 are of like construction to the pulleys 74 on upper mast section 24.

Figure 11:
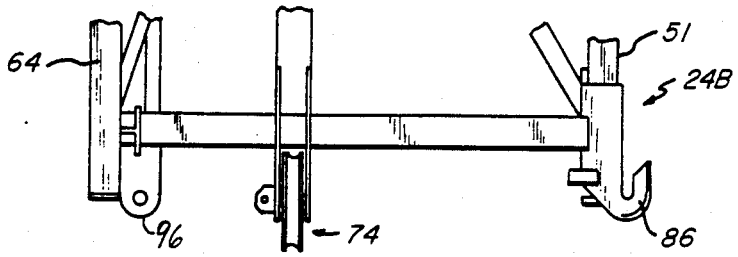
FIGS. 11 and 12 are enlarged views of portions of the well mast of FIG. 10 disassembled from each other.

A connector lug 94 (FIG. 12) is formed at an upper end 92A of support leg 92. The connector lug 94 is adapted to align with a connector lug 96 extending downwardly from the lower end 24B of upper mast section 24 (FIG. 11). In the lower position (FIG. 8), connector lugs 94 and 96 cannot be brought initially into contact with each other, due to the pivotal connection between pivot pins 78 and hooks 86.

Figure 9:
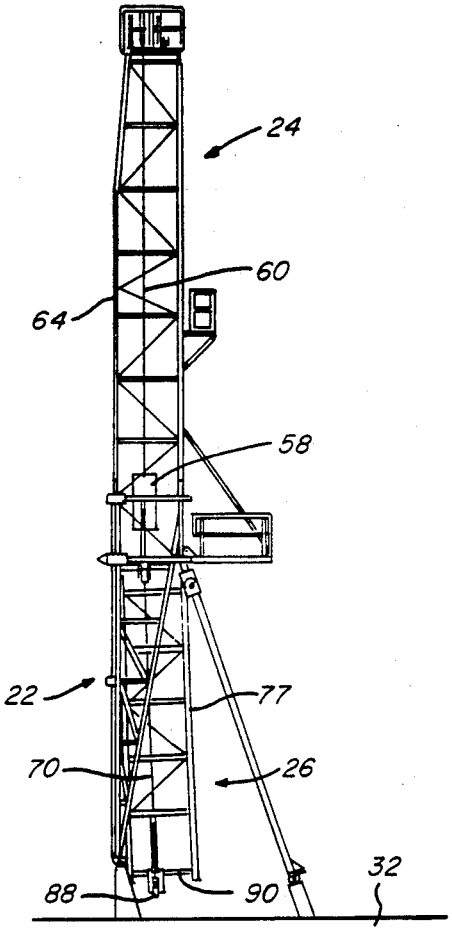

Accordingly, the travelling block 58 is lowered within mast section 26 and connected to raising lines 70 which are passed over pulleys 88. The travelling block 58 is then raised, pivoting the upper end 26A of mast section 26 upwardly (FIG. 9) so that connector lugs 94 and 96 are aligned and can be locked together. The lock between the upper mast section 22 and lower mast section is then released, so that the travelling block 58 may be raised to lift mast sections 24 and 26 upwardly. Upward lifting of mast sections 24 and 26 continues until lock structure of like structure to that of mast section 24 at the lower end of 26B of mast section 26 is aligned with the lock structure at the upper end 22A of lower mast section 22. The mast sections 22 and 26 are then locked together at their locking structure, and the raising lines 70 released, completing the raising of the mast structure 20 (FIG. 10).

Various modifications and alterations in the disclosed apparatus and methods will be apparent to those skilled in the art of the foregoing description which does not depart from the spirit of the invention. For this reason, these changes are to be considered included in the appended claims. The appended claims recite the only limitation to the present invention, and the descriptive matter which is employed for setting forth the embodiments is to be interpreted as illustrative and not a limitation.

What is claimed is:

1. A method of raising a well mast at a well site, comprising the steps of:

attaching a lower mast section having an upper end and a lower end to a well platform;

positioning the lower mast section in a fixed substantially vertical position on the well platform;

grasping a second mast section having an upper end and a lower end at a lifting position intermediate said ends of said second mast section;

moving the second mast section to a location near the upper end of the lower mast section;

maintaining the second mast section substantially horizontal during said steps of grasping and moving;

connecting the second mast section at a connector position intermediate said ends of said second mast section to the upper end of the lower mast section; and rotating the second mast section to a position within the lower mast section.

2. The method in claim 1, further including the steps of:

grasping the lower mast section at a lifting position thereof intermediate said ends of said lower mast section before said step of positioning;

moving the lower mast section to the well platform for attachment thereto before said step of positioning; and maintaining the lower mast section substantially horizontal during said steps of grasping and moving the lower mast section.

3. The method of claim 2, further including the step of:

rotating the upper end of said lower mast section about a position on said lower mast section until said lower mast section is fixed in a substantially vertical position at the well site.

4. The method in claim 1, further including the step of:

maintaining the second mast section substantially horizontal during said step of connecting.

5. The method in claim 1, further including the step of:

balancing the second mast section during said steps of grasping and moving.

6. The method in claim 1, further including the step of:

controlling and guiding relative pivotal movement of the second mast section to the vertical lower mast section during said steps of connecting and rotating.

7. The method in claim 1, wherein the lifting position is laterally offset from the connector position, the method further comprising the step of:

controlling and guiding relative pivotal movement of the second mast section to the vertical lower mast section during said steps of connecting and rotating.

8. The method of claim 1, further including the steps of:

movably positioning the second mast section in a retracted vertical position within the vertical lower mast section after said step of rotating; and moving the second mast section between the retracted vertical position and an extended upward position.

9. The method of claim 8, further including the steps of:

grasping a third mast section having an upper end and a lower end at a lifting position thereof intermediate said ends;

moving the third mast section to a location near the lower end of the second mast section in the extended upward position;

maintaining the third mast section substantially horizontal during said steps of grasping and moving of the third mast section;

connecting the third mast section at a connector position near the upper end of said third mast section to the lower end of the second mast section; and releasing the grasp on the third mast section at said lifting position on said third mast section so that said third mast section may rotate to a position within the lower mast section.

10. The method of claim 9, further including the step of:

balancing the third mast section during said steps of grasping and moving the third mast section.

11. The method of claim 9, further including the step of:

controlling and guiding relative pivotal movement of the third mast section to the vertical lower mast section during said steps of connecting and releasing the third mast section.

* * * * *